US005215488A

United States Patent [19]

Bailey

[11] Patent Number: 5,215,488

[45] Date of Patent: Jun. 1, 1993

[54] LOCKING DEVICE FOR RELEASABLY RETAINING FINS ONTO SAILBOARDS AND LIKE WATER CRAFT

[76] Inventor: Steven J. Bailey, 2860 Atlanta Dr., Tracy, Calif. 95376

[21] Appl. No.: 904,474

[22] Filed: Jun. 25, 1992

Related U.S. Application Data

[63] Continuation of Ser. No. 804,693, Jan. 22, 1992, abandoned.

[51] Int. Cl.[5] ..... A63C 15/05

[52] U.S. Cl. ..... 441/79; 24/510; 403/325

[58] Field of Search ..... 441/70, 73, 74, 79; 114/39.2, 127, 132, 140, 218; 24/461, 466, 490, 499, 500, 501, 509, 510, 523; 403/325

[56] References Cited

U.S. PATENT DOCUMENTS 4,297,963 11/1981 Beacom ..... 114/218
4,701,144 10/1987 DeWitt ..... 441/79
4,964,826 10/1990 Lobe ..... 441/79

*Primary Examiner*—Jesûs D. Sotelo

[57] ABSTRACT

An essentially flat parallelogram-shaped locking nut with rotational biasing spring is disclosed as part of a locking device attached to a supporting tongue of a nautical fin for water craft, such as sailboards, where their hulls or keels either contain or may be modified to contain an elongated channeled mounting box with internally recessed lateral grooves for receiving said nut and thereby locking the fin to the hull.

2 Claims, 3 Drawing Sheets

LOCKING DEVICE FOR RELEASABLY RETAINING FINS ONTO SAILBOARDS AND LIKE WATER CRAFT

CROSS-REFERENCE

This is a continuation of application Ser. No. 07/804,693, filed Jan. 22, 1992, now abandoned.

BACKGROUND OF THE INVENTION

The present invention generally relates to sailboards and like water craft which structurally incorporate a downwardly projecting fin for lateral support while in the water.

More particularly, the present invention pertains to detachable fins mounted in supporting channels located in the bottom of said boards and crafts whereby the fins may be removed or adjusted.

Even more specifically, the present invention concerns a parallelogram-shaped nut with biasing spring engaging said channel for locking the fin thereto.

PRIOR ART

As it is perhaps well known, sailboarding is a very popular nautical sport utilizing an elongated and relatively flat board with a fin projecting downwardly from its bottom generally towards the rear for lateral support while in the water. Historically, the fins of these boards were mounted permanently thereon as part of their integral structure, however it became readily apparent that fins were easily damaged or destroyed while riding the boards onto rocks or over partially submerged structures resulting in very costly repairs. Moreover, as the sport took on a more professional perspective, mainly due to competition among its enthusiasts, it was found that proper positioning of the fin in relation to and in respect of the rider's handling of the board often meant the difference of winning or losing an event.

A parallel analysis of the importance of the fin can be easily analogized with design of a keel in sailboat competition where today the full keels and skegs of bygone years have often been replaced with fin keels which are also easily damaged and need occasional repair, replacement or adjustment.

In view of the importance and problems associated with fins, several relevant inventions can be found in the prior art and are briefly discussed here to particularly distinguish and point out the advantages of the present invention.

For example, in U.S. Pat. No. 3,422,471 (1967), Morey and Pope describe an elongated channel in the rear undersurface of a surfboard for receiving the base portion of the skeg, one end of the channel being undercut to define a sloping surface and one end of the skeg base portion having a similarly sloping surface to wedge with the channel sloping surface. A threaded bolt and socket is provided between the other end of the channel and base portion such that after the base portion of the skeg is received in the channel, an expanding means is actuated to urge the sloping front portion of the base against the undercut sloping wall of the channel thereby wedging the skeg tightly in the channel. Although the present invention utilizes a threaded bolt, it does not incorporate a socket nor expanding means, but rather a parallelogram-shaped nut with spring biasing means to detachably engage grooves in the channel thereby providing a lock and key-type means for easily attaching or removing the fin in the field.

In U.S. Pat. No. 3,516,099 (1968), Morey and Pope disclose another mounting structure consisting of a channeled mounting box in the rearward portion of a surfboard for receiving the base of a fin or skeg which is then secured in the box by screws. As the screws are tightened the side walls of the base become snugly wedged in the box, however the present invention does not require wedging between the sides of the fin base and the mounting box. In fact, it is the locking mechanism itself that becomes wedged in a mounting box or channel.

In U.S. Pat. No. 3,659,300 (1969), Johnson describes another mounting box containing a series of enlargements in the form of cavities for cooperating and receiving a series of flanges on a fin's base so as to engage within the mounting box in a very tight position but also at a desired longitudinal position relative to a surfboard. Although the present invention does not employ flanges, the Johnson patent is cited for recognizing the importance of positioning the fin in the mounting box by a lock and key means thereby allowing not only interlocking but longitudinal adjustment of the fin with respect to its supporting structure.

Several other removable and adjustable fins for surfboards and sailboards are described in U.S. Pat. Nos. 3,965,514 (1975); 4,044,416 (1976); 4,804,347 (1987), all of which utilize elongated channels or troughs for receiving a fin base but none use a locking device similar to the present invention.

Locking devices with biasing compression springs are also known in the prior art, such as in U.S. Pat. No. 4,297,963 (1981), where Beacom describes an inverted T-bar locking device of uniform cross-section and integral construction so that its bottom may be inserted through the spaces between planks of a boat dock and then turned 90 degrees so that the bottom of said inverted T-bar is traversely locked beneath a set of planks. Its vertical shaft, projecting upwardly through said planks, goes through a circular washer resting on the top of said planks, across the spaces thereof, said washer being forced downwardly thereon by a compression spring circumscribing said shaft and retained thereon by a stop at the top.

Beacom's invention should be distinguished from the present invention several ways. First, Beacom's use is for securing boats and sea planes to planking of a dock where there is enough space between the planking to insert the shaft. It was not designed nor described to attach fins to the hulls of water craft.

Structurally, Beacom's shaft is a unitary inverted T-bar with what are essentially two washers on its vertical shaft separated by a spring. The bottom washer forms vertical support for the shaft in cooperation with the bottom of said T-bar, both of which clamp a set of planks between them caused by the force of the spring.

The present invention comprises a threaded bolt and parallelogram-shaped nut with the compression spring on the opposite side of its supporting structure or tongue, so as to not only hold said bolt above said tongue, but also to cause rotational bias against the nut when the bolt is turned, thereby also turning the nut.

Moreover, even if the device of Beacom could be inverted and somehow positioned into a fin's tongue, there would remain the problem of the shaft also projecting downwardly with the fin which is obviously undesirable as it would defeat the very purpose of a fin extending beneath the hull of a water craft as in pointed out in the following further discussion.

In the 1980's, breakaway fins became known in the art, as illustrated in U.S. Pat. No. 4,701,144 (1987), wherein DeWitt describes a breakaway surfboard fin holder in conjunction with a supporting channel mounted in the lower, rear surface of a surfboard. In his disclosure, and as is presently found in the art, the supporting channel contains a pair of elongated lateral grooves internally recessed into the channel's sidewalls in cooperation with a pair of vertical slots for receiving and engaging a pair of pins projecting transversally from the rearward end of an anchoring tongue along the base of the fin. This arrangement allows the rearward portion of the fin's tongue to be inserted into the channel's grooves to a desired position.

DeWitt goes on to claim a breakaway tab in a slot formed in a forward portion of the fin which is connected by a bolt to a flat nut which also slidably rides in said channel's lateral grooves so that when the forward portion of the fin is inserted into the channel his bolt may be threaded into the nut for a tight connection.

Although the present invention does not comprise a breakaway tab, it may further be distinguished from DeWitt by its parallelogram-shaped nut with biasing spring mounted in the forward end of an anchoring tongue where in an open position it may be easily inserted into a channel box and then conveniently closed and locked by simply turning the head of a bolt clockwise with a screw driver or coin causing the biasing spring to engage by friction the nut and turn it across and into the recessed lateral grooves of the channel resulting in both lateral and vertical support for the fin. This is believed to be a major improvement over the prior art.

Another breakaway fin device is described in U.S. Pat. No. 4,964,826 (1990), where Lobe has essentially eliminated the tab of DeWitt by providing a weakened sliding nut or flat member within the grooves of a channel box for threaded connection by a common bolt with a forward anchoring portion of a fin's tongue. Although the scored nut or weakened member of Lobe substitutes for the tab of DeWitt, both prior art inventions require that the nut or flat fastening means be independently placed into the channel groves and subsequently aligned with the threaded bolt. This is difficult to do under actual field conditions, for example, on a sandy beach in absence of tools or under sporting competition where time is of the essence and the timely replacement of a damaged fin could mean the difference between winning or loosing an event.

The present invention is believed an improvement over both DeWitt and Lobe in that the parallelogram-shaped nut, or corresponding flat member, may be viewed as a part of a fin's tongue, being retained thereon by a bolt and biasing spring for rapid and easy installation of a replacement or repaired fin without the need for manual alignment of the fastening means.

Moreover, and as illustrated in this discussion of the prior art, it can be seen that many of today's fins employ a set of pins projecting transversely from the rear portion of their anchoring tongues for slidingly engagement into grooves in a channel box. Although the present invention is also applicable to and may be used to secure fins of these types, it should be pointed out that a further advantage of this present invention is that fin pins are not necessarily required for the practice of this invention because only a second locking device of the preferred embodiment may be easily substituted by simply drilling a vertical hole in the rearward portion of the tongue thereby providing a passageway for another bolt for engagement of a parallelogram-type bolt with biasing spring to rearwardly engage grooves of a channel box. In other words, and what is believed to be a patentable distinction of the present invention over the prior art is that the parallelogram-shaped nut, having a width shorter than its length or that of its receiving channel, may be inserted into the channel while in an open position, but when closed in a locked diagonal position across said channel's grooves provides both vertical and lateral support for the fin while allowing its positioning in said channel.

Having thus discussed and distinguished the prior art, it is the general object of the present invention to provide an improved locking device for releasably retaining fins onto sailboards and like water craft.

SUMMARY OF THE INVENTION

The present invention provides a device for locking fins to and unlocking fins from a hull of a water craft where said hull is equipped with a channeled mounting box containing a pair of elongated grooves internally recessed into the channel's sidewalls. In its preferred embodiment the present invention is practiced with fins of a type which employ an anchoring tongue as part of their structural base for insertion into said channel of the mounting box, the rearward portion of said tongue containing a pair of pins projecting transversally therefrom for pivotally retaining the fin in said channel grooves, and the forward portion of said tongue providing means for a locking device thereon.

A vertical hole in the forward end of the tongue receives a common threaded bolt upwardly, through the tongue and compression spring thereon, whereby said bolt is fastened into a threaded parallelogram-shaped nut which, when in an open position may be inserted into the channel of a mounting box with said tongue, but when closed by turning the head of the bolt transversally, the nut also traverses the channel and engages elongated grooves in the sidewalls thereby providing (in conjunction with said pins) both lateral and vertical support for the fin.

DETAILED DESCRIPTION OF THE PREFERRED EMBODIMENT

Figure 1:
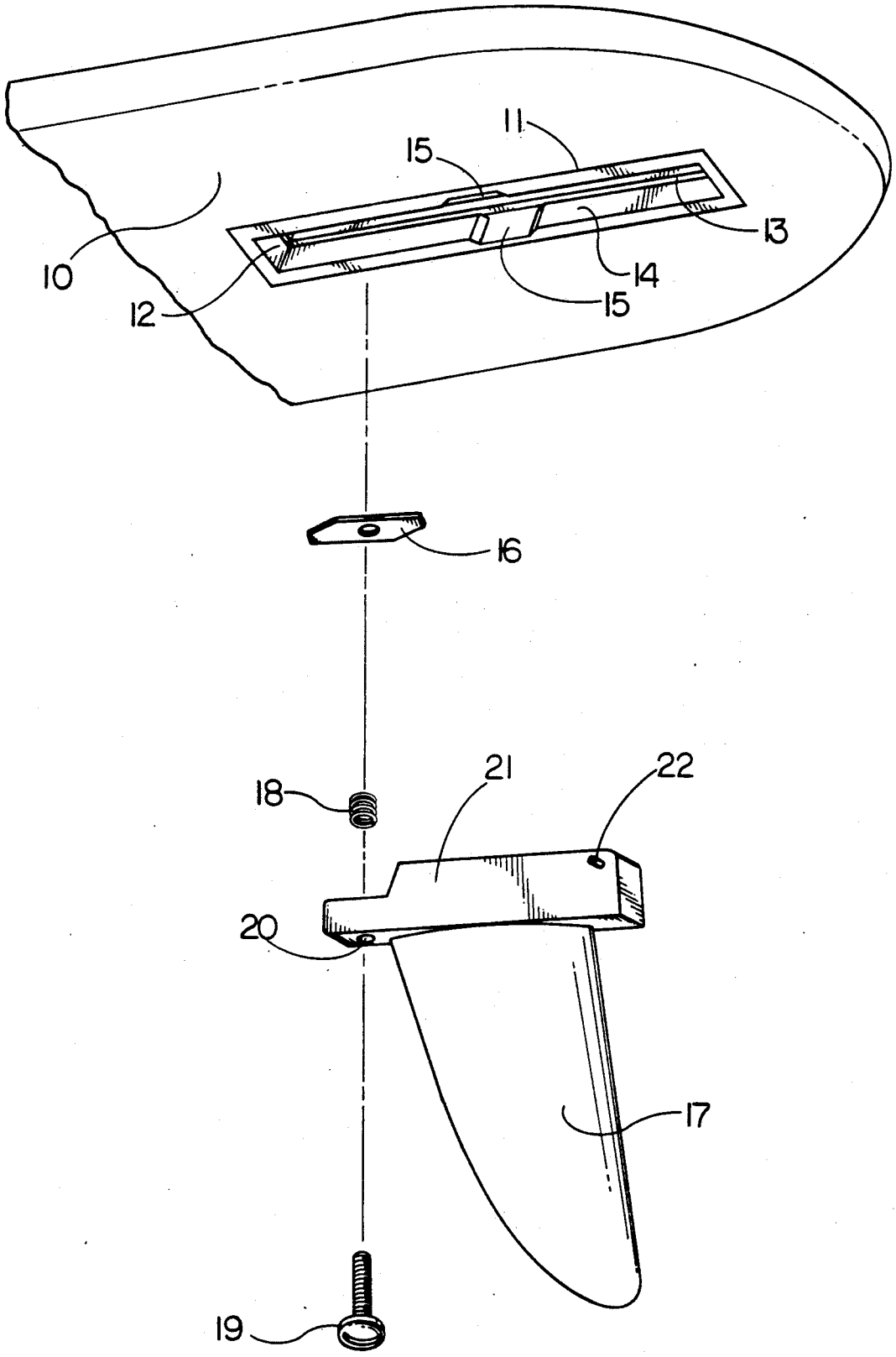
FIG. 1 is an exploded partial perspective view of the preferred embodiment as seen from an underside of a typical water craft.

Referring now to FIG. 1, there is illustrated an exploded partial perspective view of the essential elements of the present invention where a hull 10 or bottom of a typical water craft, such as a sailboard, is shown with a rectangular channeled mounting box 11 inserted therein. Although a relatively flat hull 10 is illustrated, it should be understood at the outset that said hull 10 could as well have been illustrated as a narrow keel extended stem to stern along an underside of a variety of vessels where said mounting box 11 may be installed. It should be further noted that the mounting box 11 is of a familiar type found in the prior art so that no specific claim is made thereto apart from the present invention.

As can be seen in FIG. 1, the mounting box 11 contains an elongated channel 12 with lateral grooves 13 internally recessed into the channel's sidewalls 14. A pair of enlarged slots 15 are also found in the mounting boxes 11 of this type for receiving an essentially square flat nut which rides in the grooves 13 forward of said slots 15, but has now been eliminated and replaced by an essentially flat parallelogram-shaped nut 16 of the present invention. This nut 16 is believed an improvement over the square shaped nuts and other fastening means of the prior art because in the open position as illustrated in FIG. 1 (although an exploded view), access to the channel 12 may be accomplished without aid of slots 15 and while attached to a fin 17.

A biasing compression spring 18 circumscribes a common threaded bolt 19, said bolt 19 being inserted through a vertical hole 20 in an anchoring tongue 21 of the fin 17.

Figure 7:
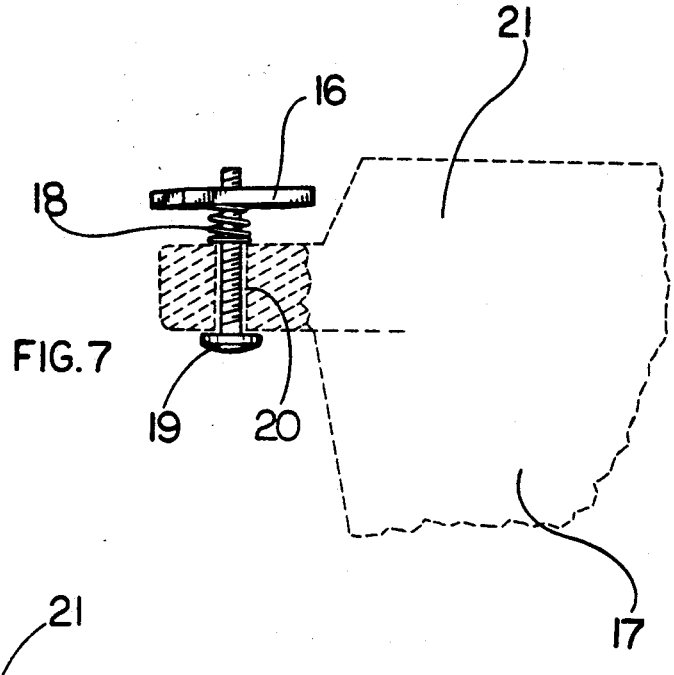
FIG. 7 is a side elevational view illustrating an open position with respect to a fin.
Figure 8:
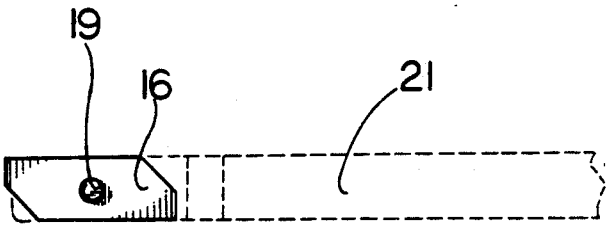
FIG. 8 is a top plan view in an open position on a tongue of a fin.
Figure 9:
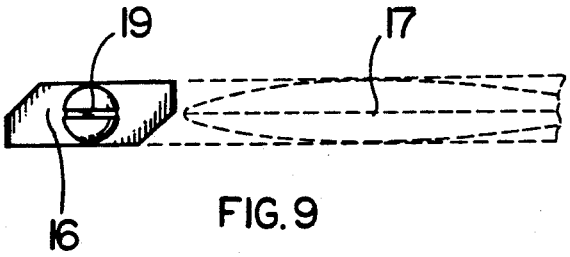
FIG. 9 is a bottom plan view.
Figure 10:
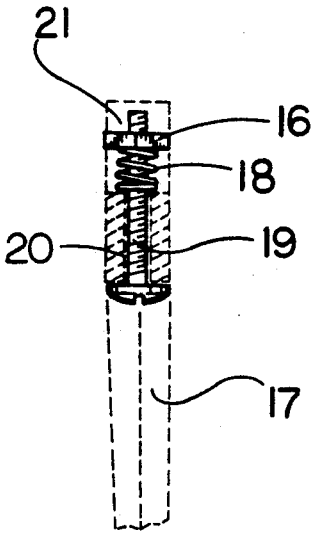
FIG. 10 is an end elevational view of said device.

As previously explained, the spring 18 serves at least two purposes as distinguished from the prior art. First, when assembled to the fin as illustrated in FIG. 7, said spring 18 serves to hold the nut 16 above the tongue so that it may be properly positioned into the channel 12. Secondly, the spring 18 causes a rotational bias by friction on the nut 16 when bolt 19 is turned thereby also turning the nut 16 across the channel 12 and into the grooves 13 as illustrated in FIG. 2.

FIGS. 3 and 7 through 10 illustrate views of the present invention with respect to typical fin designs required for its practice. An anchoring tongue 21 usually provides a vertical hole 20 in its forward portion to accommodate various other types of locking devices described in the prior art, so prior art devices may be easily replaced with the device of the present invention at very little cost and without the need to replace an existing fin.

Figure 2:
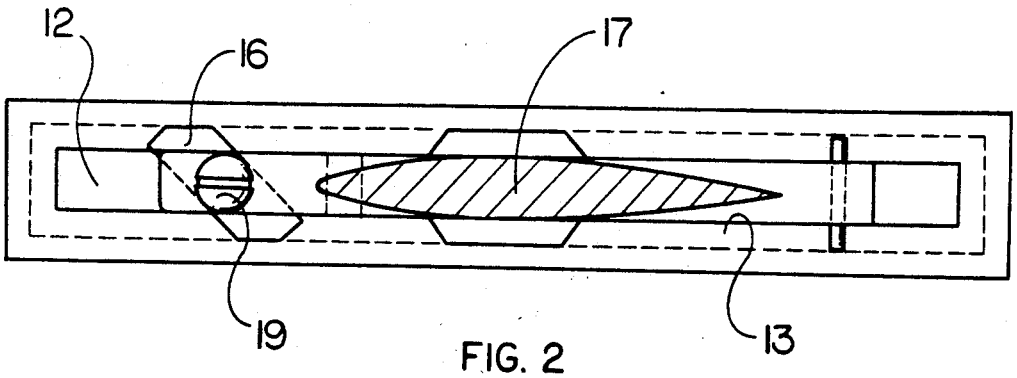
FIG. 2 is a bottom plan sectional view illustration of a locked position.
Figure 3:
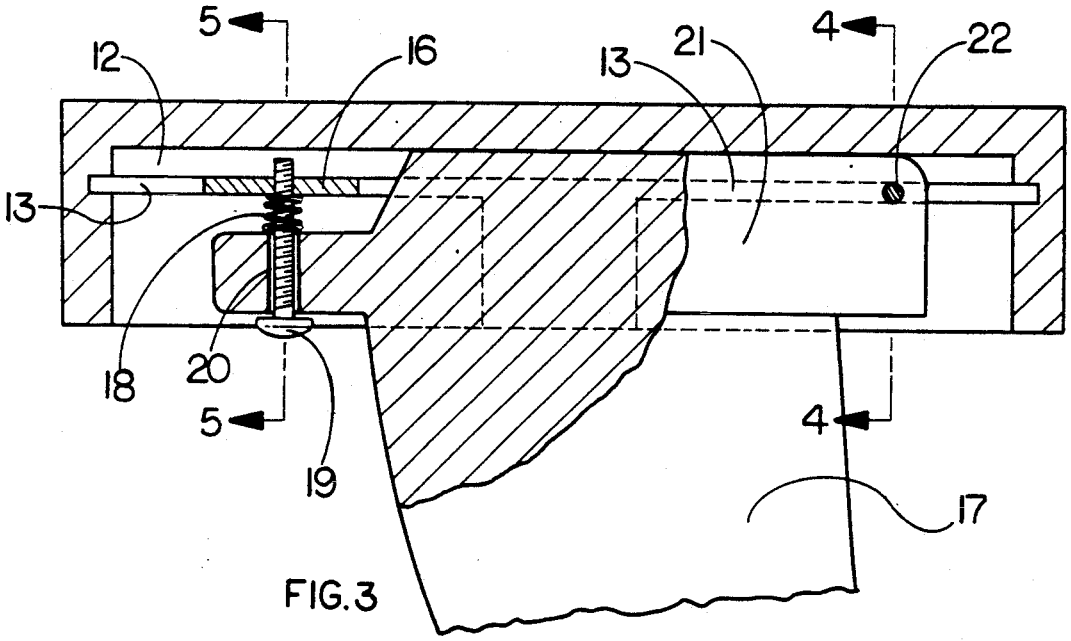
FIG. 3 is a partial sectional side elevational view illustrating a locked position.
Figure 4:
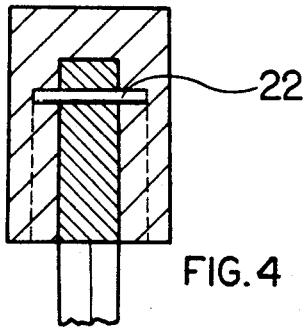
FIG. 4 is a section on the line 4—4 of FIG. 2.
Figure 5:
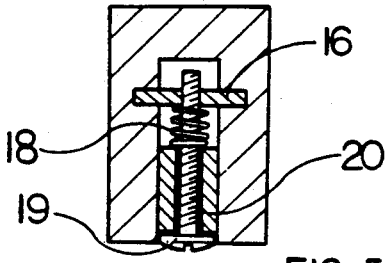
FIG. 5 is a section on the line 5—5 of FIG. 2.
Figure 6:
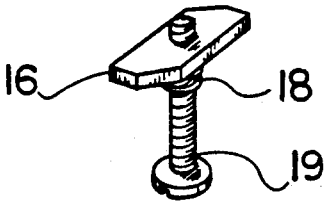
FIG. 6 is a perspective view of the locking device removed from a fin.

The rearward portion of the tongue 21, as seen in FIGS. 3 and 4, generally has a pair of pins 22 transversely projecting therefrom for inserting through a set of slots 15, as shown in FIGS. 1 and 2, into channel grooves 13 (FIGS. 1 through 3) for longitudinal positioning of a fin 17 in respect to the hull 10. However, as was also previously pointed out and what is believed yet another and further advantage of the present invention, is that pins 22 could be easily replaced with the locking device of the present invention which would provide both support and positioning while making installation and removal of the fin 17 very simple.

I claim:

1. A releasably locking nautical fin for water craft comprising:

A. water craft having a hull;

B. a mounting box attached to the hull;

C. an elongated channel in the mounting box;

D. recessed lateral grooves in the channel's walls;

E. a fin with anchoring tongue for inserting into said channel, further comprising:

1. a locking device comprising:
   a. a bolt with a threaded portion for inserting upwardly through said tongue;
   b. a compression spring for circumscribing said threaded portion of the bolt above said tongue;
   c. an essentially parallelogram-shaped nut for attaching to said bolt above the spring, so that said spring positionally holds the nut above the tongue and also provides rotational bias on the nut when the bolt is turned thereby causing said nut to traverse said channel in the said mounting box of a water craft hull and become locked across said grooves of the channel walls.

2. In a nautical fin projecting downwardly from a hull of water craft, and said fin having an anchoring tongue for inserting into a mounting channel structure in said hull, the improvement being:

A. a locking device on said tongue comprising:

1. a common threaded bolt extending upwardly through the tongue;
2. a biasing compression spring circumscribing the bolt;
3. an essentially flat parallelogram-shaped nut threaded onto said bolt, above said compression spring, for inserting with said tongue into said channel structure in the hull so that when the bolt is turned, the nut is also turned by frictional bias of the spring causing the nut to traverse the channel thereby locking the fin to the hull.

* * * * *